US005104421A

United States Patent [19]

Takizawa et al.

[11] Patent Number: 5,104,421

[45] Date of Patent: Apr. 14, 1992

[54] POLISHING METHOD OF GOODS AND ABRASIVE PAD THEREFOR

[75] Inventors: Gisaburo Takizawa; Tetsushi Senda; Shiro Miura, all of Aichi, Japan

[73] Assignee: Fujimi Abrasives Co., Ltd., Aichi, Japan

[21] Appl. No.: 613,359

[22] Filed: Nov. 14, 1990

[30] Foreign Application Priority Data

Mar. 23, 1990 [JP] Japan ..... 2-71894
Apr. 27, 1990 [JP] Japan ..... 2-110376

[51] Int. Cl.[5] ..... B24B 1/00

[52] U.S. Cl. ..... 51/295; 51/298; 51/303; 51/304; 51/309; 106/3

[58] Field of Search ..... 51/295, 298, 303, 304, 51/309; 106/3

[56] References Cited

U.S. PATENT DOCUMENTS 4,189,395 2/1980 Bland ..... 51/295
4,225,349 9/1980 Koshiyama et al. ..... 51/308
4,255,164 3/1981 Butzle et al. ..... 51/295
4,576,612 3/1986 Shukla et al. ..... 51/295
4,581,042 4/1986 Willmore ..... 106/3
4,696,697 9/1987 Kitano et al. ..... 51/307
4,859,359 8/1989 De Matteo et al. ..... 106/3
5,000,761 3/1991 Mayton et al. ..... 106/3

*Primary Examiner*—William R. Dixon, Jr.
*Assistant Examiner*—Willie J. Thompson
*Attorney, Agent, or Firm*—Abelman, Frayne, and Schwab

[57] ABSTRACT

A polishing method and abrasive pads used to polish of abrade, for example, lenses. The pad is manufactured with an abrasives such as grains of the mean diameter: 0.5-10 μm of alumina, zirconium oxide, tin oxide, and cerium oxide, a kind of water-soluble cellulose ether selected from the group of hydroxypropylmethyl and the like, and a kind of insolubilizing agent such as glyoxal, citric acid, and the like. The substances above are blended and coated on a sheet-like substrate. In polishing process, only water is poured between the rotating abrasives pad and goods to be polished.

11 Claims, 2 Drawing Sheets

FIG. 2(a)
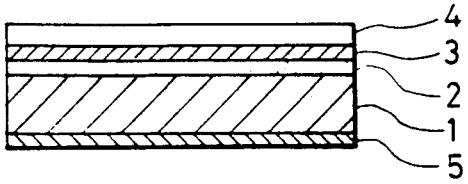
FIG. 2(c)
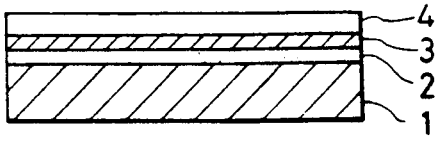
FIG. 2(b)
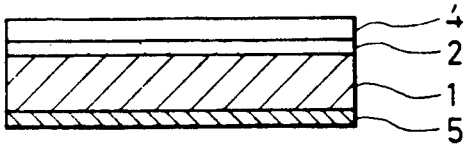
FIG. 2(d)
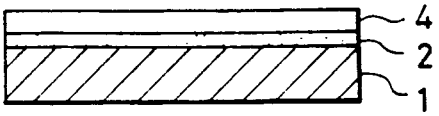
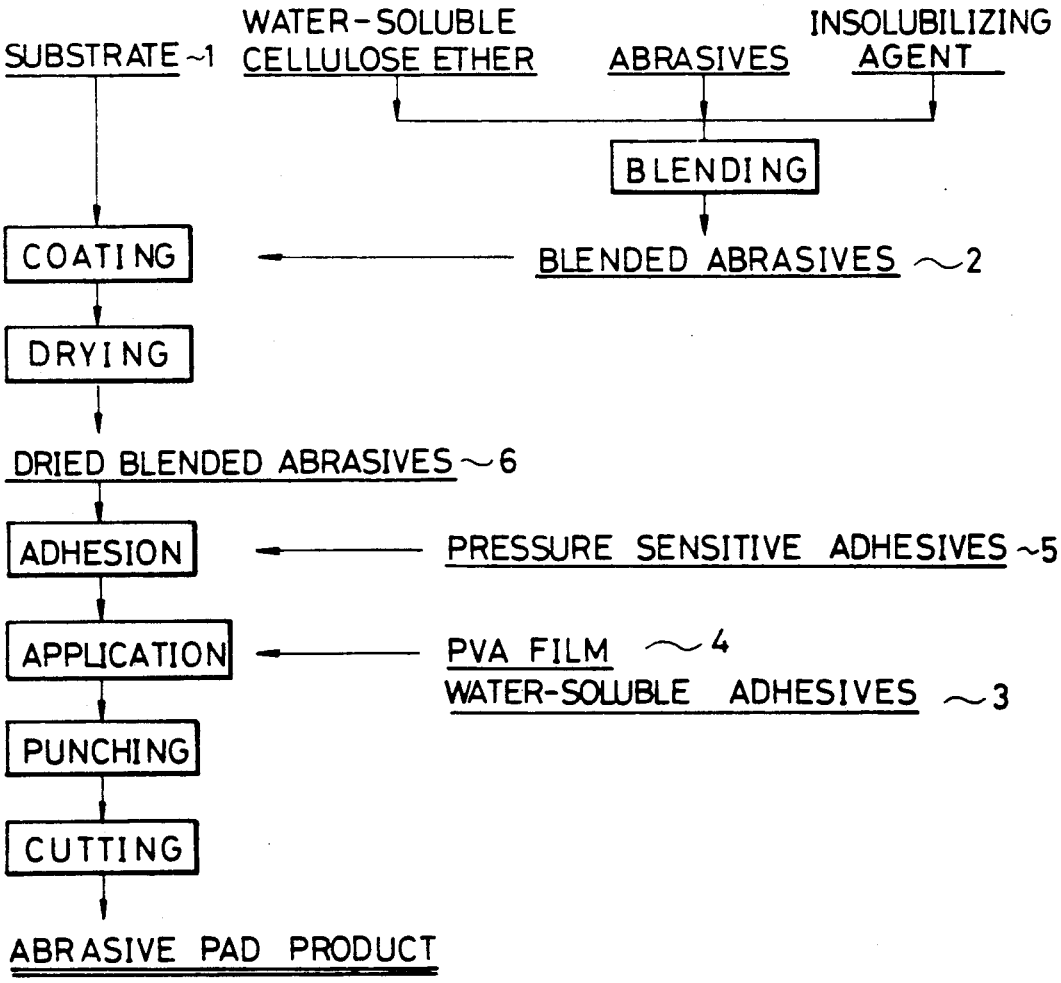
FIG. 3

POLISHING METHOD OF GOODS AND ABRASIVE PAD THEREFOR

FIELD OF THE INVENTION

The present invention relates to a polishing method of goods and abrasive pads used therein, in particular, to a polishing method and abrasive pads, which are usefully employed to synthetic resin such as plastic lenses, windshield glass, medical goods, tableware, radio parts, machinery parts buttons, caps, cabinets, decorative board, glasses frame, plastic-made safety glass and metal, glass, and semiconductor materials.

PRIOR ART

Lately, Patent Application Laid-open No. 49-100689, U.S. Pat. No. 4,225,347, and Patent Application Laid-open No. 61-278589 (U.S. Pat. No. 4,696,697) have been published to describe polishing methods for polishing synthetic resin and metals and polishing compositions used therefor.

Patent application Laid-open No. 100,689 (U.S. Pat. No. 4,225,349) describes a polishing method and a polishing composition for synthetic resin, in particular, the composition consists of water, polishing agent and acidic compound.

According to the prior art, slurry consisting of water and polishing agents such as cerium oxide and alumina is used. Comparing Patent Application Laid-open No. 49-100689 to the prior art, the former is a polishing method using polishing composition prepared by adding polishing accelerator (acidic compound), such as polyaluminum chloride, aluminum sulfate, aluminum nitrate, aluminum chloride and aluminum bromide to the slurry of polishing composition of the prior art.

The polishing method using polishing composition for polishing goods, which composition consisting of water, abrasives and oxodizing compound can polish at high efficiency and high quality, in particular, plastics. It is noted that disadvantageously the polishing slurry is of strong acid having so low pH value about 4—2.

Consequently, the polishing machine and jigs are apt to corrode and problems on sanitation and safe, such as roughen hands of the operator of the machine are arisen.

The applicant of the present invention has applied an application of Patent Application Laid-open No. 61-278587 (U.S. Pat. No. 4,696,697 mentioned-above) in order to solve the problems above, which application describes a polishing composition of neutral or weak acid and consisting of water abrasives of alumina and polishing accelerator of nickel sulfate.

All polishing composition described above are used in a state of slurry, so that complicated appliance of a pumps, an agitator, thermal controllers and pipings are necessary to supply abrasive slurry resulting in often poor operativity of the polishing work.

Nowadays the typical conventional sheet-like abrasives of sand papers and polishing tapes have been used, these abrasives being manufactured by bonding abrasive grains or particles on the faces of paper or fabric sheet-like substrates through synthetic water-soluble high molecular compound such as polyvinyl alcohol or natural substance such as gelatin. Recently, abrasive grains are adhered by waterproof synthetic resin bond of phenol, epoxy, urethane, vinyl acetate and acryl on the substrates use as rough finish abrasive.

The conventional sand paper and polishing tapes manufactured by using such water-soluble bonds have no waterproofness and poor bonding strength resulting in swift falling of grains from the faces of sand paper. On the contrary, waterproof synthetic resin adhesives are too effective to suitably remove the grains resulting in stuffing or loading sand papers by chips or broken pieces of goods polished and in short life of the sand papers. When the sand paper has small grains less than 10 μm adapted to be used for mirror finish, a trend toward loading the sand paper becomes large resulting in poor polishing productivity. As a result, nowadays, conventional polishing compositions using grains in slurry have been used to polish plastics, metal, and glass and the like.

SUMMARY OF THE INVENTION

It is the purpose of the present invention to provide a unique polishing method and abrasive pads adapted to polish goods with good operability or workability and efficiency in order to solve the aforementioned problems of the prior art such as ones of sanitary and safe.

BRIEF DESCRIPTION OF THE DRAWING

FIG. 3 is an explanation view of manufacture of the abrasive pad.

Figure 1A:
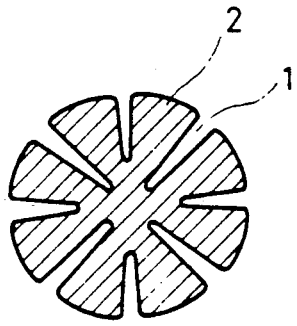
FIG. 1(*a*)–(*e*), respectively show patterns of the abrasive pads of various embodiments of the present invention, FIG. 2(*a*)–(*d*) is a section of the abrasive pad of the embodiment or example.

The abrasive pad used in the polishing method according to the present invention is made of water-soluble cellulose ether which can become hard to soluble in water by dehydro-condensing the hydroxy groups in its chemical structure with other compounds containing hydroxy group in its chemical structure and performing cross linkage of difficulty to soluble in water between chains.

Crosslinking agents, such as glyoxal, citric acid tannic acid, urea formalin resin and methylol melamine resin are used in manufacture of the abrasive pad according to the present invention as an insolubilizing agent.

Consequently, when the abrasive pad of the present invention is used to polish goods, only water is supplied and poured on to the pad. That is, the abrasive pad has excellent abrasion faces of high productivity. During polishing processes of the method according to the present invention decreased water-soluble cellulose ether used in the pad as binders of alumina polishing agents dissolves little by little, so that new abrasive faces are suitably generated keeping suitable polishing efficiency. Furthermore, the binder and the pad substrate have suitable cushion and elasticity effect contributing to obtain the good finished surfaces.

Next, the conditions of abrasive grains will be explained.

When the mean diameter of abrasive grains is less than 0.5 μm, the quality of goods abraded or polished is good. However, because the grain diameter is small, sufficient stock removal rate will not be obtained after completion of the polishing process. When the mean diameter of the grains exceeds 10 μm, rough finished surface will be obtained and no mirror finish are attained. Further, deep scratch is apt to be formed when grains exceeding 10 μm in mean diameter are used, so it is preferable to use that mean diameter of 0.5–10 μm.

When the ratio in weight of water-soluble cellulose ether to the abrasives is less than 1%, it is difficult to obtain sufficient adhesive force. However, when it is more than 8%, adhesion or adhesive force becomes too strong and loading phenomenon is happened on the abrasive faces of abrasive pads resulting in no self-creative or developing function of new abrasives grains of suitable or effective and no adequate stock removal. Consequently, about 1-8% of the weight ratio of water-soluble cellulose ether to the abrasives was determined.

When the weight ratio of insolubilizing agent to the abrasives is less than 0.2%, the adhesive force of abrasives is not adequate, similar to the case of water-soluble cellulose ether, so that removal or falling-out speed of grains becomes high. When the weight ratio exceeds 1.5%, adhesive force becomes too effective unsuitably generating loading phenomenon on the abrasive pads. Considering polishing function and economy, 0.2-1.5% of the weight ratio is suitable.

It is possible to select one of the substrates, for example, flocked fabric, flocked synthetic resin film, non-woven fabric, synthetic paper, artificial leather, woven fabric, synthetic resin film and sponge and use the selected one as the substrate of the abrasive pad according to the present device.

It is apparent that the polishing method of the present device can polish effectively the goods with supply of only water such as general tap water in the polishing process, so that no polishing machine and no jigs corrode and there is no problem of rough hands of operators.

Because only water is poured on the goods to be polished and abrasives are not slurried, there is no necessity to install a slurry feeding system and a simple water-supply device is sufficient to be provided, so that operativity and efficiency of the polishing method are considerably improved.

The abrasive pad according to the present invention may be laminated with water using a PVA film on an upper face of the dried blended abrasives layer or by adhering using a water-soluble acrylic adhesive agent, so that without lowering polishing performance of the resultant abrasives, problems such as chipping-off, stripping-off and dirtying the upper layer of the abrasive pad in the manufacturing process can be prevented.

It is noted that PVA films have good solubility in water and then, so pouring water on the film earlier step in the polishing step solves it resulting in no effect to polishing operation and polishing effect of goods.

When the thickness of the PVA film and the adhesive layer are less than 10 μm, adhesion effect is not sufficient. When these exceed 40 μm and 30 μm, respectively, materials of PVA film and adhesive layer are remained and they effect badly polishing performance to be attained in the polishing process. Consequently, 10-40 μm and 10-30 μm of the thickness are preferable.

Further, it is necessary to throughly dissolve the PVA film in water during polishing processes, so the PVA film must have its saponification value of about 80-90.

Now, the abrasives, water-soluble cellulose ether and insolubilizing agent consisting of the dried blended abrasives will be explained.

The abrasives is one kind of the group consisting of alumina, zirconium oxide, tin oxide and cerium oxide, and it preferably had the mean diameter of grains: 0.5-10 μm.

The weight ratio of water-soluble cellulose ether to abrasive is 1-8% and the cellulose ether is preferably one of the group consisting of hydroxypropylmethyl cellulose, methyl cellulose, and hydroxyethylmethyl cellulose.

The weight ratio of the insolubilizing agent to abrasives is 0.2-1.5% and the insolubilizing agent is preferably one of the group consisting of glyoxal, citric acid, tannic acid, urea formaldehyde resin and metheylol melamine resin.

The substrate is one selected from the group of flocked fabric flocked synthetic resin film non-woven fabric, synthetic paper, artificial leather, woven fabric, synthetic resin film and sponge.

As described above, the abrasive pad of the present invention can be used with only water-supplying thereon, so that any polishing machine and jigs do not corrode and hands of the operator are not roughed. Further, because there is water-supply in polishing process of goods, slurried abrasives are not necessary to prepare and any installation for making abrasives slurried is not needed and only simple mechanism is needed to supply water considerably improving a workability of polishing.

According to the polishing method of goods and abrasive pads used in the polishing method of the present invention, goods can be polished in high efficiency and with high quality, similar to the conventional polishing method employing slurry consisting of abrasives and acidic compounds, with only water-supply without problems of corrosion and rough hands of the operator. A complicated polishing apparatus is not necessary and operatively or workability of the polishing process will be improved according to the present invention.

The adhesive pad is manufactured by adhering a polyvinyl film to the upper face of the dried blended abrasives consisting of a substrate and a blended abrasive of water-soluble cellulose ether and insolubilizing agent, so that the covered layer (abrasives layer) does not peel of chip, dirty. As a result, commercial value of the product of the abrasive pad and the yields are improved without discoloring and deterioration of the covered layer due to anti-humidity effect of the film and aging in quality.

Similar to the conventional polishing composition, the abrasive pad can polish goods in high efficiency and high quality. On the contrary, not similar to the conventional abrasives of slurry type, the abrasive pad of the present invention can be used with only water-supply resulting in no problems of corrosion and rough hands. Further no complicated abrasive-related appliance is needed in the polishing method of the present application and the workability can be considerably improved.

Examples of the present invention will be explained.

EXAMPLE 1

Figure 1B:
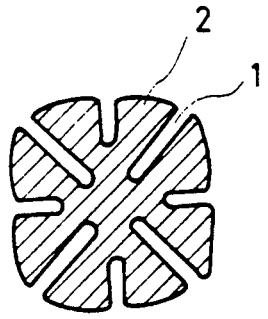
Figure 1C:
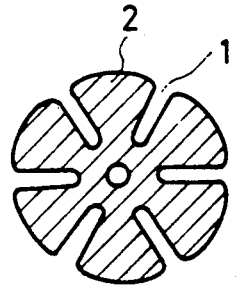
Figure 1D:
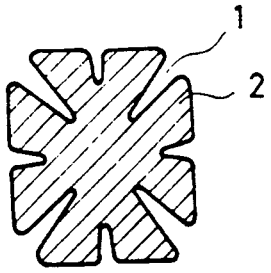
Figure 1E:
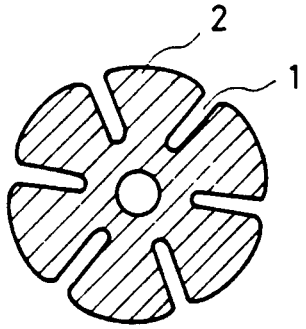

In FIG. 1, reference numeral 1 is a substrate and 2 is a blended abrasive.

40 part in weight of abrasives grains of α-alumina having the mean diameter: 3 μm was blended with 60 part in weight of water making a water-soluble cellulose ether. A weight part of hidroxypropylmethyl cellulose (weight % relative to abrasives: Conversion B) was added as shown below.

TABLE 1

| Weight part A | Conversion B % |
|---|---|
| 0.5 | 1.25 |

TABLE 1-continued

| Weight part A | Conversion B % |
|---|---|
| 1.0 | 2.5 |
| 1.25 | 3.125 |
| 1.5 | 3.75 |
| 2.0 | 5.0 |
| 2.5 | 6.25 |
| 3.0 | 7.5 |

0.5 weight part (weight % conversion relative to abrasive: 0.75%) 40% solution of glyoxal (CHOCHO) of an insolubilizing agent is added and throughly blended in order to make a paste blend.

A substrate 1 of rayon-made flocked fabric used to conventionally polish plastic lenses was prepared and the paste blend was applied or coated uniformly on the surface of the flocked fabric at a ratio of 1200 g per 1 $m^2$ of the blanket. Then, the blanket was dried at 120C. degree for 60 minutes in an electric drying oven in order to obtain a dried blended abrasives 6 of abrasives at a weight of about 500 g per 1 $m^2$ (thickness 0.4 mm).

A pressure sensitive adhesive 5 such as double face adhesive tape was laminated to the rear face of flocked fabric piece 1 used as a substrate of the dried blended abrasives. Then, it was punched and cut to the desired form selected from the various forms of abrasive pads as shown in FIG. 1 and the cut pieces of the abrasive pad of the present invention were used in experiments to determine their performance.

Comparing to the abrasive pad of the present invention, a conventional, slurry abrasive composition was made by suspending 20 weight % of abrasives of α-alumina having the mean diameter: 3 μm which corresponding to that of the present invention in water and 5 weight % of polishing accelerator of nickel sulfate ($NiSO_4.6H_2O$) was added to the suspension.

A plastic goods product, for example, plastic lenses for glasses made of 70 mm dia allydiglycole carbonate resin pieces was used in the polishing test. The lens fitted into a non-spherical lense polisher, and the abrasive pad of the present invention or a conventional flocked fabric piece was pressed to a face of the lens.

They were slided to or rubbed against each other for five minutes to polish the lens.

According to the present invention, only water at a rate of 2 l/minute was supplied between the lens and the abrasive pad. In the conventional process, abrasives slurry is supplied on a circulation system between these above at a rate of 2 l/minute. A pressure of 240 g/$cm^2$ is used in these polishing process.

After the polishing process, the faces of lenses were checked to determine degree of finish and any existence of surface defects such as orange peels or scratches.

Next, weight of the lenses were measured in order to determine removed weight due to the polishing.

TABLE 2

| added weight part of cellulose | added weight part of insolubiliz-ing agent | stock removal rate (mg/5 min) | surface defects |
|---|---|---|---|
| | Present Invention | | |
| 0.5 | 0.5 | 60 | no |
| 1.0 | 0.5 | 80 | no |
| 1.25 | 0.5 | 135 | no |
| 1.5 | 0.5 | 180 | no |
| 2.0 | 0.5 | 200 | no |
| 2.5 | 0.5 | 90 | no |
| 3.0 | 0.5 | 75 | no |

TABLE 2-continued

| added weight part of cellulose | added weight part of insolubiliz-ing agent | stock removal rate (mg/5 min) | surface defects |
|---|---|---|---|
| | prior art | | |
| — | — | 105 | no |

As apparent from Table 2 above, in cases that added weight parts of water-soluble cellulose ether were 0.5 and 3.0, there was no surface defect and stock removal rate was relatively decreased. In conclusion, 1–8% of weight ratio relatively to the abrasives apparently was preferable.

In the polishing method of the present invention, abrasive having the mean grain dia: 3 μm was used, since when abrasives less than 0.5 μm is used, polishing quality was good, but stock removal was not sufficient due to smaller diameter of grains, and when abrasives more than 10 μm is used, polished surfaces were rough obtaining non-mirror faces and deep scratches are apt to be generated.

Using the abrasive pad of the present invention, the polishing process of goods, can be done with only water-supply and stock removal was large, similar to the conventional method using slurry abrasives, obtaining very high polishing productivity and high quality of polished surfaces without surface defect.

EXAMPLE 2

Similar to Example 1, abrasives of α-alumina of the mean gain diameter: 1 μm and 6 μm were used to manufacture abrasive pads. Another abrasives of α-alumina of corresponding mean diameter to the present invention was used to form conventional polishing composition. These abrasives were tested as shown in Table 3.

TABLE 3

| abrasive grain mean dia (μm) | added weight part of cellulose | added weight part of insolubilizing hardener agent | stock removal rate (mg/5 min) | surface defect |
|---|---|---|---|---|
| | | present invention | | |
| 1.0 | 1.0 | 0.5 | 95 | no |
| 1.0 | 2.0 | 0.5 | 80 | no |
| 6.0 | 1.5 | 0.5 | 150 | no |
| 6.0 | 2.0 | 0.5 | 240 | no |
| 6.0 | 2.5 | 0.5 | 100 | no |
| | | prior art | | |
| 1.0 | — | — | 90 | no |
| 6.0 | — | — | 135 | no |

As described in Table 3, even though the mean grain diameter of abrasives increased to 1 μm and 6 μm, stock removal was much and there is no surface defect, resulting in apparently good quality of polishing comparing to the conventional case.

According to the Example 2, the thickness of the abrasives was 0.4 mm, but it can change according to the particular kind of the substrate. In general, when a plastics of not permeable is used, abrasives of thickness: about 0.1–1.0 mm can be used preferably on the basis of strength and economy of the abrasive pad. The pattern of the abrasive pad can be changed according to kind and shape of goods to be polished.

EXAMPLE 3

In FIG. 2, a reference numeral 1 is a substrate, 2 is a blended abrasives, 3 is a water-soluble adhesives, 4 is a PVA film and 5 is a pressure sensitive adhesive.

The Example 3 will be explained according to a manufacturing process of the abrasive pad of the present invention.

Abrasives of α-alumina of the mean grain diameter: 3 μm, 40 weight and water, 60 weight part were blended, and water-soluble cellulose ether of hydroxypropylmethyl cellulose, A weight part (weight % conversion B relative to abrasive) was added as shown in Table 1 of Example 1.

Further, 40% solution of glyoxal (CHOCHO) of an insolubilizing agent, 0.5 weight part (weight % conversion relative to abrasive: 0.75%) was added to the resultant and it was throughly blended obtaining paste abrasive 2.

A rayon-made flocked fabric of the substrate 1 used for polishing conventional plastic lens was prepared. Blended pate abrasive 2 was coated uniformly on the surfaces at a rate of 1200 g/1 $m^2$ and it was dried by an electric drying oven of about 120 C. degree for 60 minutes so as to obtain a dried blended abrasives 6 of about 500 g (thickness 0.4 mm) per 1 $m^2$.

The pressure sensitive adhesive agent 5 such as double sided adhesive tape was bonded to the back of the flocked fabric used as a substrate 1 of the dried blended abrasive 6. Next, as shown in FIG. 3 the PVA film 4 of a saponification value of 80–90 and thickness: 20 μm was laminated with water, or an acrylic water-soluble adhesive 3 was adhered to the whole surface of it.

Next, as shown in FIG. 1, a particular one was selected from the various shapes of the abrasive pads, the resultant raw pad was punched and cut into the shape to manufacture the abrasive pad. Coating the adhesive surface of the PVA film, no part of the top covered layer (blended abrasives 2) chips, peels off and dirties improving the commercial value of products and yields.

Owing to a waterproof effect of the surface coating, no discoloring and no change in quality or deterioration are happened and aging is not generated making the quality stable.

The abrasive pad thus produced was used in the experiment.

A conventional polishing composition was used as a comparison example in the experiment. The polishing composition had been prepared by making a suspension of 20 weight % of α-alumina having the mean grain diameter: 3 μm corresponding to that of the present invention and using it as an abrasives. 5 weight % of polishing accelerator of nickel sulfate ($NiSO_4.6H_2O$) was added to the abrasives making slurry one.

A lens of 70 mm dia made of allyldiglycole carbonate resin was used as a plastic product to be polished. This lens fits to non-spherical lens polisher and a conventional flocked fabric piece or the abrasive pad according to the present invention comes into contact with the faces of the lens, sliding the both relatively and in pressure for five minutes.

During the polishing process according to the present invention, only water of 2 l/minute was supplied between the lens and abrasive pad. According to the conventional process, abrasives slurry is poured at a rate of 2 l/minute of a circulation system corresponding to the present invention. The polishing pressure was 240 g/$cm^2$ for both the processes.

After the polishing step, the polished surface of the lens was examined to check surface finish and surface defects such as orange peel and scratches.

Next, the weight of lenses were measured in order to determine weight loss due to polishing and stock removal. These results will be shown in Table 4.

As apparent from Table 4, the abrasive pad of the present invention can be effectively used with only pouring water resulting in, similar to the conventional process using abrasives slurry, high stock removal rate, very high polishing efficiency, and high quality of polished surface without surface defects.

TABLE 4

| added weight part of cellulose | added weight part of insolubilizing agent | stock removal rate (mg/5 min) | surface defects |
|---|---|---|---|
| | present invention | | |
| 0.5 | 0.5 | 60 | no |
| 1.0 | 0.5 | 80 | no |
| 1.25 | 0.5 | 135 | no |
| 1.5 | 0.5 | 180 | no |
| 2.0 | 0.5 | 200 | no |
| 2.5 | 0.5 | 90 | no |
| 3.0 | 0.5 | 75 | no |
| | prior art | | |
| — | — | 105 | no |

According to the examples above, after adhering of the pressure sensitive adhesive 5, the PAV film 4 was adhered to the pad. However, the order of adhering of lamination of these materials can be reversed.

The abrasive pad mentioned above of the present invention is not limited to the examples above.

We claim:

1. An abrasive pad comprising a substrate and a blend comprised of abrasives, water-soluble cellulose ether, and insolubilizing agent, which blend is coated on the substrate.

2. The abrasive pad according to claim 1, wherein the mean grain diameter of said abrasives is 0.5–10 μm.

3. The abrasive pad according to claim 2, wherein said abrasives is one selected from the group of alumina, zirconium oxide, tin oxide, and cerium oxide.

4. The abrasive pad according to claim 1, wherein the weight ratio of said water-soluble cellulose ether relative to the abrasives is 1–8%.

5. The abrasive pad according to claim 4, wherein said water-soluble cellulose ether is one selected from the group of hydroxypropyl methyl cellulose, methyl cellulose, and hydroxyethylmethyl cellulose.

6. The abrasive pad according to claim 1, wherein the weight ratio of the insolubilizing agent relative to abrasives is 0.2–1.5%.

7. The abrasive pad according to claim 6, wherein said insolubilizing agent is one selected from the group of glyoxal, citric acid, tannic acid, urea-formaldehyde resin and methylol melamine resin.

8. The abrasive pad according to claim 1 wherein said substrate is one selected from the group of flocked fabric, flocked synthetic resin film, non-woven fabric, synthetic paper, artificial leather, woven fabric, synthetic resin film, and sponge.

9. The abrasive pad comprising a substrate, a blended abrasive comprising abrasives, water-soluble cellulose ether, and an insolubilizing agent coated in the shape of a sheet on said substrate, and a polyvinyl alcohol film laminated with water or water-soluble adhesive agent.

10. The abrasive pad according to claim 9, wherein the thickness of said polyvinyl alcohol film is 10–40 μm and the saponification number is 80–90.

11. The abrasive pad according to claim 9, wherein the thickness of said water-soluble adhesive layer is 5–30 μm.

* * * * *

US005104421A

REEXAMINATION CERTIFICATE (2139th)

United States Patent [19]

Takizawa et al.

[11] B1 5,104,421

[45] Certificate Issued Nov. 16, 1993

[54] POLISHING METHOD OF GOODS AND ABRASIVE PAD THEREFOR

[75] Inventors: Gisaburo Takizawa; Tetsushi Senda; Shiro Miura, all of Aichi, Japan

[73] Assignee: Fujimi Abrasives Co., Ltd., Aichi, Japan

Reexamination Request:
No. 90/002,873, Oct. 30, 1992

Reexamination Certificate for:

| | |
|---|---|
| Patent No.: | **5,104,421** |
| Issued: | **Apr. 14, 1992** |
| Appl. No.: | **613,359** |
| Filed: | **Nov. 14, 1990** |

[30] Foreign Application Priority Data

Mar. 23, 1990 [JP] Japan ..... 2-71894
Apr. 27, 1990 [JP] Japan ..... 2-110376

[51] Int. Cl.[5] ..... B24B 1/00
[52] U.S. Cl. ..... 51/295; 51/298; 51/303; 51/304; 51/309; 106/3
[58] Field of Search ..... 51/295, 298, 303, 304, 51/309; 106/3

[56] References Cited

U.S. PATENT DOCUMENTS

| | | | |
|---|---|---|---|
| 2,280,852 | 4/1942 | Robie | 51/303 |
| 4,189,395 | 2/1980 | Bland | 51/295 |
| 4,225,349 | 9/1980 | Koshiyama et al. | 51/308 |
| 4,255,164 | 3/1981 | Butzle et al. | 51/295 |
| 4,576,612 | 3/1986 | Shukla et al. | 51/295 |
| 4,581,042 | 4/1986 | Willmore | 106/3 |
| 4,696,697 | 9/1987 | Kitano et al. | 51/307 |
| 4,859,359 | 8/1989 | De Matteo et al. | 106/3 |
| 5,000,761 | 3/1991 | Mayton et al. | 106/3 |

OTHER PUBLICATIONS

Webster's New Universal Unabridged Dictionary, Second Edition, Dorset & Baber-p. 194.
The Condensed Chemical Dictionary, 7th. Ed., 1966, pp. 729, 768, 995.

*Primary Examiner*—Mark Bell

[57] ABSTRACT

A polishing method and abrasive pads used to polish of abrade, for example, lenses. The pad is manufactured with an abrasives such as grains of the mean diameter: 0.5–10 μm of alumina, zirconium oxide, tin oxide, and cerium oxide, a kind of water-soluble cellulose ether selected from the group of hydroxypropylmethyl and the like, and a kind of insolubilizing agent such as glyoxal, citric acid and the like. The substances above are blended and coated on a sheet-like substrate. In polishing process, only water is poured between the rotating abrasives pad and goods to be polished.

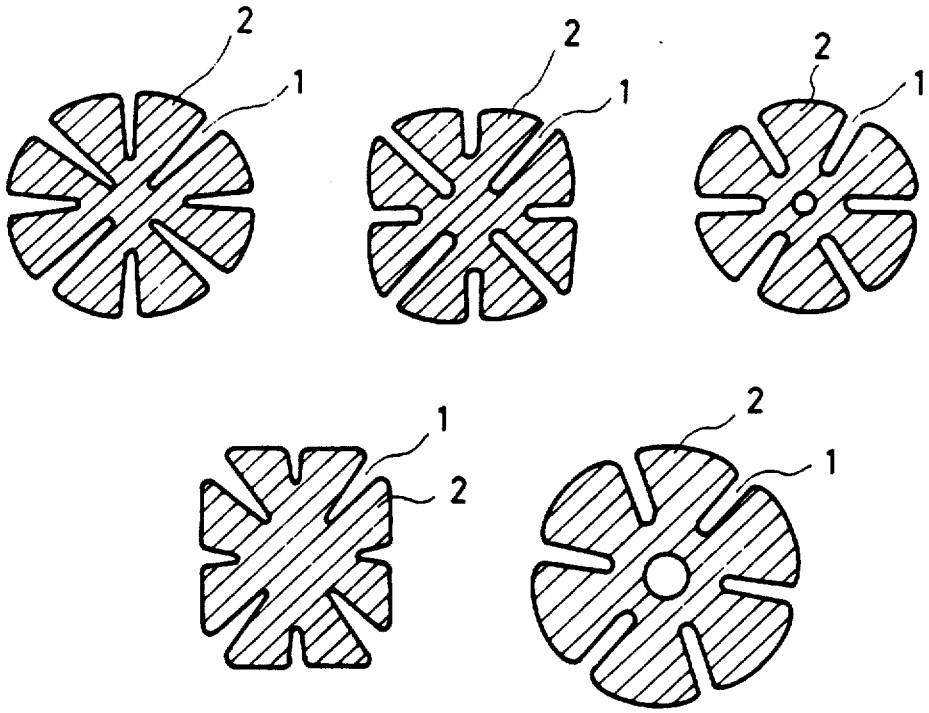

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 2, 5 and 7 are cancelled.

Claims 1 and 9 are determined to be patentable as amended.

Claims 3, 4, 6, 8, 10 and 11, dependent on an amended claim, are determined to be patentable.

1. An abrasive pad comprising a substrate and a *paste* blend comprised of [abrasives] *abrasive materials having an average grain size within the range of 0.5–10 μm mixed with water, a* water-soluble cellulose ether *selected from the group consisting of hydroxypropyl methyl cellulose or hydroxyethylmethyl cellulose*, and *an* insolubilizing agent *selected from the group consisting of glyoxal, citric acid and methylol melamine resin*, [which] *said paste* blend [is] *being* coated on [the] *said* substrate *and dried.*

9. [The] *An* abrasive pad comprising a substrate, a [blended abrasive] *paste blend* comprising [abrasives] *abrasive materials having an average grain size between 0.5–10 μm mixed with water, a* water-soluble cellulose ether *selected from the group consisting of hydroxypropyl methyl cellulose or hydroxyethylmethyl cellulose*, and an insolubilizing agent *selected from the group consisting of glyoxal, citric acid, and methylol melamine resin, said paste blend being* coated in the shape of a sheet on said substrate *and dried*, and a polyvinyl alcohol film laminated with water or *a* water-soluble adhesive agent.

* * * * *